United States Patent [19]

Akashi et al.

[11] 4,212,937

[45] Jul. 15, 1980

[54] HEAT DEVELOPABLE PHOTOSENSITIVE MATERIALS

[75] Inventors: Kageyasu Akashi; Minoru Akiyama; Tetsuo Shiga; Takeki Matsui; Yoshio Hayashi; Takeo Kimura; Hidehiko Kobayashi, all of Fuji, Japan

[73] Assignee: Asahi Kasei Kogyl Kabushiki Kaisha, Tokyo, Japan

[21] Appl. No.: 969,620

[22] Filed: Dec. 14, 1978

[30] Foreign Application Priority Data

Dec. 23, 1977 [JP] Japan ..... 52-154353
May 31, 1978 [JP] Japan ..... 53-64241

[51] Int. Cl.[2] ..... G03C 1/02

[52] U.S. Cl. ..... 430/620; 430/353; 430/600; 430/613

[58] Field of Search ..... 96/114.1, 109, 66.5, 96/66.4, 95, 94 R, 94 BF, 66 T, 107

[56] References Cited

U.S. PATENT DOCUMENTS

| | | | |
|---|---|---|---|
| 3,457,075 | 7/1969 | Morgan et al. | 96/114.1 |
| 3,689,270 | 9/1972 | Anderson et al. | 96/114.1 |
| 3,770,448 | 11/1973 | Poot et al. | 96/114.1 |
| 3,782,941 | 1/1974 | Hartman et al. | 96/114.1 |
| 3,832,186 | 8/1974 | Masuda et al. | 96/114.1 |
| 3,846,136 | 11/1974 | Sullivan | 96/114.1 |
| 3,874,946 | 4/1975 | Costa et al. | 96/114.1 |
| 3,877,943 | 4/1975 | Masuda | 96/114.1 |
| 3,885,967 | 5/1975 | Sashihara et al. | 96/114.1 |
| 3,951,660 | 4/1976 | Hagemann et al. | 96/114.1 |
| 3,980,482 | 9/1976 | Reece | 96/114.1 |
| 3,997,346 | 12/1976 | Masuda et al. | 96/114.1 |
| 4,003,749 | 1/1977 | Masuda et al. | 96/114.1 |
| 4,009,039 | 2/1977 | Masuda et al. | 96/114.1 |
| 4,021,247 | 5/1977 | Hinata et al. | 96/109 |
| 4,076,539 | 2/1978 | Ikenoue et al. | 96/94 BF |
| 4,120,728 | 10/1978 | Ikenoue et al. | 96/94 BF |
| 4,128,428 | 12/1978 | Ikenoue et al. | 96/114.1 |

*Primary Examiner*—Travis Brown
*Attorney, Agent, or Firm*—Sprung, Felfe, Horn, Lynch & Kramer

[57] ABSTRACT

A heat developable photosensitive material comprising:

(a) an organic silver salt oxidizing agent;

(b) a halogen molecule or an organic haloamide compound;

(c) a reducing agent for silver ion; and (d) a nitrogen-containing organic base whose pKa of the conjugate acid ranges from 0.5 to 10.0 and the nitrogen-containing organic base having, in its molecule, no acidic proton or a nitrogen-containing organic base whose pKa of its conjugate acid ranges from 0.5 to 10.0 and the nitrogen-containing organic base having, in its molecule, an acidic proton whose pKa is more than 12.

11 Claims, No Drawings

HEAT DEVELOPABLE PHOTOSENSITIVE MATERIALS

BACKGROUND OF THE INVENTION

1. Field of the Invention

This invention relates to a heat developable photosensitive material. More specifically, it relates to a heat developable photosensitive material having excellent sensitivity and storage stability, which comprises a nitrogen-containing organic base whose conjugate acid has a pKa of from 0.5 to 10.0.

2. Description of the Prior Art

Conventional wet processing photosensitive materials using a silver halide emulsion are excellent in their sensitivity, gradation and image quality, but they need complicated time consuming processes using various treating chemicals in obtaining stable images. Further, the chemicals used give rise to a pollution problem. Accordingly, there have been proposed many photosensitive materials capable of forming images thereon easily only by dry processing in a short period of time without using treating chemicals. Such heat developable photosensitive materials use an organic silver salt oxidizing agent as its main component and may be classified into two groups. One is a pre-activation type heat developable photosensitive material on which images can be formed by the imagewise exposure and then the heat development, and the other is a post-activation type heat developable photosensitive material which is non-photosensitive under normal light conditions and can be rendered photosensitive by the preliminary heating prior to the imagewise exposure. For example, the former is described in U.S. Pat. Nos. 3,152,904 and 3,457,075, and the latter is described in U.S. Pat. Nos. 3,802,888 and 3,764,329.

However, the sensitivities of these heat developable photosensitive materials thus proposed are remarkably lower than those of the conventional photosensitive materials containing a silver halide emulsion, and thus utilization of these heat developable photosensitive materials for general purposes are still limited.

SUMMARY OF THE INVENTION

Extensive investigation have now been made in order to obtain a dry image forming material having excellent sensitivity and storage stability under normal light conditions for practical purposes. These investigations have led to the discovery that a heat developable photosensitive material having remarkably improved properties can be obtained by combining a halogen molecule or an organic haloamide compound as the whole or a part of a compound capable of forming a photosensitive silver compound with a nitrogen-containing organic base whose pKa of the conjugate acid ranges from 0.5 to 10.0.

Accordingly, the present invention provides a heat developable photosensitive material comprising:

(a) an organic silver salt oxidizing agent;

(b) a halogen molecule or an organic haloamide compound;

(c) a reducing agent for silver ion; and (d) a nitrogen-containing organic base whose pKa of the conjugate acid ranges from 0.5 to 10.0 and the nitrogen-containing organic base having, in its molecule, no acidic proton or a nitrogen-containing organic base whose pKa of the conjugate acid ranges from 0.5 to 10.0 and the nitrogen-containing organic base having, in its molecule, an acidic proton whose pKa is more than 12.

DETAILED DESCRIPTION OF THE INVENTION

In this invention by using the above-described component (d) together with the above-described component (b) as the whole or a part of a component capable of forming a photosensitive silver compound, the sensitivities of the heat developable photosensitive materials of this invention can be remarkably increased without reducing their storage stabilities. This may be presumed that since the heat developable photosensitive materials of this invention comprises a halogen molecule or an organic haloamide compound having a strong oxidizability, the use of such a nitrogen-containing organic base can increase their sensitivities without reducing their storage stabilities. When the nitrogen-containing organic base is used together with halogen ion sources other than the halogen molecule or the organic haloamide compound, the sensitivities of the photosensitive materials can be increased but the storage stabilities are remarkably reduced.

The storage stabilities of the heat developable photosensitive materials comprising, in addition to the halogen molecule or the organic haloamide compound, a very strong nitrogen-containing organic base whose conjugate acid has a pKa above 10.0 such as N-methylpiperidine whose conjugate acid has a pKa of 10.1, N-methylpyrrolidine whose conjugate acid has a pKa of 10.4 and pyrrolidine whose conjugate acid has a pKa of 11.3 are low. Also the sensitivities of the heat developable photosensitive materials comprising, in addition to the halogen molecule or the organic haloamide compound, a weak nitrogen-containing organic base whose conjugate acid has a pKa below 0.5 such as 2-fluoropyridine whose conjugate acid has a pKa of 0.4 can hardly be increased.

According to this invention in case where the nitrogen-containing organic base has an acidic proton in its molecule even when the pKa of the conjugate acid of the nitrogen-containing organic base ranges from 0.5 to 10.0, an anti-fogging effect by the acidic component appears at the same time. When the pKa of an acidic proton is more than 12 as with benzimidazole or pyrazole, the effect by the acidic component hardly appears as with the nitrogen-containing organic base having no acidic proton in its molecule. However, when the pKa of an acidic proton is 12 or less than 12 as with benztriazole or tetrazole, the storage stability of the photosensitive material is not reduced but the increase in its sensitivity is small.

The nitrogen-containing organic bases whose conjugate acids have a pKa of from 0.5 to 10.0 which can be employed as component (d) in the heat developable photosensitive material of this invention include pyridine, quinoline, isoquinoline, acridine, phenanthridine, pyridazine, pyrimidine, pyrazine, cinnoline, phthalazine, quinazoline, quinoxaline, phenazine, m-, o-, p-phenanthroline, pteridine, pyrazole, imidazole, benzimidazole; derivatives thereof having a substituent such as an alkyl group, a substituted alkyl group, an aryl group, a substituted aryl group, a nitro group, a halogen atom, a nitrile group, an alkoxy group or a carboxyalkyl group.

Specific examples of such derivatives include 2-chloropyridine, 3-chloropyridine, 2-bromopyridine, 3-bromopyridine, 2-methylpyridine, 3-methylpyridine, 4-methylpyridine, 2,6-diisopropylpyridine, 2-isopropylpyridine, 2-tertbutylpyridine, 3-phenylpyridine, 2,6-di-tert-butylpyridine, 3-acetylpyridine, $\alpha,\alpha'$-dipyridyl, $\beta,\beta'$-dipyridyl, $\gamma,\gamma'$-dipyridyl, 5-nitro-1,10-phenanthroline, 2-methylquinoline, 3-methylquinoline, 4-methylquinoline, 2-chloroquinoline, 4-chloroquinoline, 2-methoxyisoquinoline, 4-methylpyrimidine, 2-dimethylaminopyrimidine, 2-methoxyquinazoline, 2-methylquinoxaline, 1-methylpyrazole and 2-methylpyrazole.

Of these nitrogen-containing organic bases, 6-membered ring nitrogen-containing organic bases such as pyridine, quinoline, isoquinoline, pyrazine, phthalazine, quinoxaline, quinazoline, cinnoline, pyridazine and pyrimidine which are comparatively stable against the oxidation by the halogen molecule or the organic haloamide compound as component (b) in the heat developable photosensitive material of this invention are preferred due to their ease in handling.

The amount of the nitrogen-containing organic base typically ranges from about 0.001 mole to about 1 mole, and preferably from about 0.01 mole to about 0.5 mole per mole of the organic silver salt oxidizing agent.

The pKa and the method of measuring the same which are used in this invention are described in Adrien Albert, "Heterocyclic Chemistry, an Introduction", published by Athlone Press, University of London in 1959; Chemical Society of Japan, "Kagaku Binran (Chemical Dictionary)", published by Maruzen 1966; and E. J. King, "Acid-Base Equilibria", published by Pergamon Press, New York in 1965.

The organic silver salt oxidizing agents which can be employed as component (a) in this invention include silver salts of long chain aliphatic carboxylic acids having 12 to 24 carbon atoms such as silver laurate, silver myristate, silver palmitate, silver stearate, silver arachidate and silver behenate, silver salts of organic compounds having an imino group such as benztriazole silver salt, benzimidazole silver salt, carbazole silver salt and phthalazinone silver salt; silver salts of sulfur containing compounds such as S-alkylthioglycollates; silver salts of aromatic carboxylic acids such as silver benzoate and silver phthalate; silver salts of sulfuric acids such as silver ethanesulfonate; silver salts of sulfinic acids such as silver o-toluenesulfinate; silver salts of phosphoric acids such as silver phenylphosphate; silver barbiturate; silver saccharate; silver salts of salicylaldoxime; and any mixtures thereof. Of these compounds, the silver salts of long chain aliphatic carboxylic acids having 12 to 24 carbon atoms are preferred.

The amount of the organic silver salt oxidizing agent which can be employed in this invention typically ranges from about 0.1 $g/m^2$ to about 50 $g/m^2$ of the support area of the heat developable photosensitive material. A preferred amount of the organic silver salt oxidizing agent ranges from about 1 $g/m^2$ to about 10 $g/m^2$ of the support area of the heat developable photosensitive material.

The halogen molecules which can be employed as component (b) in this invention include iodine molecule, bromine molecule, iodine monochloride and iodine trichloride, iodine bromide and bromine chloride. The bromine chloride is preferably used in the form of a hydrate which is solid.

The term "halogen molecule" used herein includes not only the above-described halogen molecules but also complexes of a halogen molecule, for example, complexes of a halogen molecule with p-dioxane which are generally solid. Of the halogen molecules that can be used in this invention, iodine molecule which is solid under normal conditions is especially preferred.

The organic haloamide compounds which can be employed as component (b) in this invention include, for example, N-chlorosuccinimide, N-bromosuccinimide, N-iodosuccinimide, N-chlorophthalimide, N-bromophthalimide, N-iodophthalimide, N-chlorophthalazinone, N-bromophthalazinone, N-iodophthalazinone, N-chloroacetamide, N-bromoacetamide, N-iodoacetamide, N-chloroacetanilide, N-bromoacetanilide, N-iodoacetanilide, 1-chloro-3,5,5-trimethyl-2,4-imidazolidinedione, 1-bromo-3,5,5-trimethyl-2,4-imidazolidinedione, 1-iodo-3,5,5-trimethyl-2,4-imidazolidinedione, 1,3-di-chloro-5,5-dimethyl-2,4-imidazolidinedione, 1,3-dibromo-5,5-dimethyl-2,4-imidazolidinedione, 1,3-diiodo-5,5-dimethylimidazolidinedione, N,N-dichlorobenzenesulfonamide, N,N-dibromobenzenesulfonamide, N-bromo-N-methylbenzenesulfonamide, N-chloro-N-methylbenzenesulfonamide, N,N-diiodobenzenesulfonamide, N-iodo-N-methylbenzenesulfonamide, 1,3-dichloro-4,4-dimethylhydantoin, 1,3-dibromo-4,4-dimethylhydantoin and 1,3-diiodo-4,4-dimethylhydantoin.

In general, the halogen molecules are more effective for improving both the sensitivity and the storage stability of the photosensitive materials than the organic haloamide compounds. The amount of the halogen molecules or the organic haloamide compounds typically ranges from about 0.001 mole to about 0.5 mole, and preferably from about 0.01 mole to about 0.2 mole, based on the mole of the organic silver salt oxidizing agent.

In order to further increase the sensitivity of the heat developable photosensitive materials of this invention without sacrifice of their storage stability, another halogen ion sources may be used together with the above-mentioned halogen molecule or the above-mentioned organic haloamide compound.

As the halogen ion source in the photosensitive material of this invention, any of compounds capable of generating a halogen ion may be used. Examples of such halogen ion sources include calcium iodide, barium iodide, rubidium iodide, cesium iodide, aluminum iodide, magnesium iodide, sodium iodide, potassium iodide, bromides and chlorides corresponding to the above-mentioned iodides, and quaternary tetraalkyl ammonium salts such as tetraethyl ammonium salts, quaternary aralkyl trialkyl ammonium salts such as benzyl trimethyl ammonium salts and quaternary aryl trialkyl ammonium salts such as phenyl trimethyl ammonium salts, said quaternary ammonium salts being those of hydroiodic acid, hydrobromic acid and hydrochloric acid. Further examples of the halogen ion source include ionizable organic halogen compounds such as triphenylmethyl iodide and phenacyl bromide; nonmetallic halogen compounds such as triphenylphosphine diiodide, triphenylphosphine dibromide, triphenylphosphite diiodide and triphenylphosphite dibromide; halogen-containing organometallic compounds such as titanocene dichloride, zirconocene dichloride, dimethylsilyl dichloride, trimethylsilyl chloride and triphenylgermanium bromide. These compounds to be used as the halogen ion source may be used alone or in combination. The amount of the halogen ion source to be used may be about 0.1 to about 20 mole %, preferably about 0.5 to 10 mole %, based on the amount of the organic silver salt oxidizing agent.

The halogen ion source and the halogen molecule may be added separately, or a compound or compounds capable of forming a halogen ion source and a halogen molecule by reaction at the preparation of the photosensitive material may be used. Following is an explanation of the illustrate mode of use of a combination of the halogen ion source and an iodine molecule in the form of a compound or compounds described above. The explanation is made exemplifying the use of iodine as the halogen. For example, triphenylphosphite diiodide and iodine molecule can be formed by the use of triphenyl phosphite and an excessive amount of molecular iodine. Also, triphenylphosphite nonaiodide as synthesized according to the method disclosed in J. Am. Chem. Soc., 75, p. 3145 (1953) is dissociated into triphenylphosphite diiodide and molecular iodine at the time of preparation of the composition for the heat developable photosensitive material, even when it is used alone. When this triphenylphosphite nonaiodide is employed, there is obtained a photosensitive material having good storage stability and good sensitivity, and hence, the use of triphenylphosphite nonaiodide is preferred.

As exemplary combinations of the compounds, there can be mentioned combinations of molecular iodine and phosphites such as alkyl phosphites, e.g., tributyl phosphites and tristearyl phosphite, and aryl phosphites, e.g., triphenyl phosphite and tricresyl phosphites; combination of molecular iodine and phosphines such a triphenylphosphine; combination of molecular iodine and tellurides such as dibutyltelluride and diphenyl telluride; combination of molecular iodine and arsines such as triphenylarsine and tributylarsine.

The above explanation is made with respect to the case where iodine is used as a halogen molecule, but the similar combinations may be used with respect to the case of other halogen molecules.

The reducing agents for silver ion which can be used as component (c) in this invention include sterically hindered phenols in which a sterically bulky group is bonded to the carbon atom adjacent to the carbon atom bonded to the hydroxyl group; substituted phenols; hydroquinones; hydroquinone ethers; and other reducing agents for conventional wet processing silver salt type photosensitive materials.

Specific examples of such reducing agents for silver ion include 2,6-di-tert-butyl-4-methylphenol, 2,2'-methylenebis(4-methyl-6-tertbutylphenol), 2,6-methylenebis(2-hydroxy-3-tert-butyl-5-methylphenyl)4-methylphenol, 2,2'-methylenebis(4-ethyl-6-tert-butylphenol), 2,6-bis(2'-hydroxy-3'-tert-butyl-5'-methylbenzyl)4-methylphenol, 2,4,4-trimethylpentylbis(2-hydroxy-3,5-dimethylphenyl)methane, 2,2'-methylenebis[4-methyl-6-(1-methylcyclohexyl)]phenol, 2,5-di-tert-butyl-4-methoxyphenol; p-phenylphenol, p-methoxyphenol, p-aminophenol, catechol, pyrogallol, resorcin, bisphenol A, 2,4-dihydroxybenzoic acid; hydroquinone, chlorohydroquinone, bromohydroquinone, phenylhydroquinone, methylhydroquinone, tert-butylhydroquinone, tert-octylhydroquinone, 2,5-dimethylhydroquinone, 2,6-dimethylhydroquinone, methoxyhydroquinone; hydroquinone monobenzyl ether; $\alpha$-naphthol, $\beta$-naphthol, 1,3-dihydroxynaphthalene, 2,2'-dihydroxy-1,1'-binaphthyl; phenidone, methyl gallate; and any mixtures thereof.

A preferred reducing agent for silver ion can be chosen depending upon the organic salt oxidizing agent employed. For example, with an organic silver salt oxidizing agent such as silver behenate which is relatively hard to be reduced, a relatively strong reducing agent for silver ion such as a sterically hindered phenol including 2,2'-methylenebis(4-ethyl-6-tert-butylphenol) is suitably chosen. On the other hand, with an organic silver salt oxidizing agent such as silver laurate which is relatively easy to be reduced, a relatively weak reducing agent for silver ion such as a substituted phenol including p-phenylphenol is suitably chosen, and with an organic silver salt oxidizing agent such as silver salt of benztriazole which is very hard to be reduced, a strong reducing agent for silver ion such as ascorbic acid is suitably chosen.

The amount of the reducing agent for silver ion may vary depending upon the organic silver salt oxidizing agent selected. In general, the amount of the reducing agent for silver ion used ranges from about 0.1 percent by weight to about 200 percent by weight based on the weight of the organic silver salt oxidizing agent. A preferred amount of the reducing agent for silver ion ranges from about 1 percent by weight to about 100 percent by weight.

If necessary or if desired, the heat developable photosensitive materials of this invention may further comprise conventional modifiers such as a binder for film formation, a toner for silver images, an antifoggant and a background-darkening preventing agent in addition to the above-described components (a), (b), (c) and (d).

The binder is needed for film formation in many cases.

As exemplary film-forming binders, there can be mentioned polyvinyl acetate, vinyl chloride-vinyl acetate copolymers, polyvinyl chloride, polyvinyl butyral, polymethyl methacrylate, cellulose acetate, cellulose acetate propionate, cellulose acetate butyrate, polyvinyl alcohol, polyvinyl pyrrolidone, gelatin and polystyrene. They may be used along or in mixture. The film-forming binder can be used generally in such an amount that the weight ratio of the binder to the organic silver salt oxidizing agent is in the range of from about 0.1 to about 10. As the toner for a silver image, there can be mentioned, for example, phthalazinone, maleic hydrazide, benzoxazidinedione, cyclic imides, quinazolinone, 2-pyrazoline-5-one, zinc acetate and cadmium acetate. The toner may be used suitably in an amount of 0.01 to 1 mole per mole of the organic silver salt oxidizing agent.

In this invention, a practically useful photosensitive material can be prepared even if an anti-foggant is not particularly added. If a higher anti-fogging effect is required, an anti-foggant may, of course, be used in this invention. As the anti-foggant, there can be mentioned mercury salts, palladium salts, and a wide variety of acidic compounds. For example, when mercuric acetate is used as the anti-foggant in an amount as small as about 0.01 mole % based on the amount used of the organic silver salt oxidizing agent, a remarkable anti-fogging effect can be attained in the photosensitive material of this invention.

As the background-darkening preventing agent, there can be mentioned, for example, tetrabromobutane and hexabromocyclohexane. This agent may be used suitably in an amount of from about 2.5 to about 14 mole % based on the organic silver salt oxidizing agent.

A preferred method of preparing the heat developable photosensitive material of this invention is described by way of example as follows. An organic silver salt oxidizing agent as prepared separatively is dispersed in a binder solution or emulsion for a photographic emulsion by means of a sand grinder, a mixer, a ball mill or the like. To the resulting dispersion are, in turn, added additives such as a halogen molecule, a reducing agent and the like. The composition thus obtained is applied onto a support such as a plastic film, a glass plate, a paper or a metal plate to prepare a photosensitive material. As the plastic film, there can be mentioned, for example, cellulose triacetate and other cellulose acetate films, polyethylene terephthalate and other polyester films, polyamide films, polyimide films, a polyvinyl acetal film, a polystyrene film, a polyethylene film and polycarbonate films. As the paper, there can be mentioned, for example, a photographic base paper, a coated paper, an art paper and a barite paper and a water-proof paper as well as ordinary papers. An aluminum plate can be used as a metal plate by way of example.

The dry thickness of the coating is from about 1 to about 1,000μ, preferably from about 3 to about 20μ. The ingredients of the composition may be applied and laminated separately in two or more layers, optionally. The sheet material thus prepared is non-photosensitive under normal lighting conditions and it can be handled in a light room. When a given area of this sheet material is heated in the dark, this area is rendered photosensitive. This preliminary heating is preferably carreid out at a temperature of about 90° to about 200° C. If the heating temperature is elevated, the heating time may be proportionally short. When the area rendered photosensitive by heating is exposed imagewise to light and then heat-developed, a visible image is obtained. it is preferred that heat development be carried out at a temperature of about 90° to about 200° C. The heating period of time at either the preliminary heating or the heat development may be controlled within the range of from about 1 to about 60 seconds. When the preliminary heating for rendering the material photosensitive and the heat development are conducted at the same temperature, the time for the heat development is generally longer than the time for the preliminary heating. With the heat developable photosensitive materials of this invention, a visible image can be recorded selectively on a given area, and up-dated information may be additionally recorded on other areas according to need.

The present invention will now be illustrated in more detail by the following non-limiting examples.

EXAMPLE 1

To 20 parts by weight of a mixed liquid of methyl ethyl ketone and toluene in a weight ratio of 2 to 1 were added 4 parts by weight of silver behenate, and the mixture was ball-milled for about 24 hours to give a uniform silver behenate suspension.

Then, an emulsion having the first layer composition as set forth below was prepared by mixing each of its ingredients in the order described therein with stirring and coated on a polyester film as the first layer, and then dried. The thickness of the first layer was 4μ.

| First Layer Composition | |
|---|---|
| Silver behenate suspension | 12.0 g |
| Polyvinyl butyral | 3.0 g |
| Methyl ethyl ketone | 12.0 g |
| Mercuric acetate | 0.05 g |
| Iodine molecule | 0.12 g |
| Nitrogen-containing organic base in an amount as set forth in Table 1 | |

Then, another solution having the second layer composition as set forth below was prepared and coated on the first layer as the second layer, and then dried. The total thickness of the first and second layer was 7μ.

| Second Layer Composition | |
|---|---|
| Cellulose acetate | 1.2 g |
| Acetone | 16.3 g |
| Phthalazinone | 0.28 g |
| 2,2'-Methylenebis(6-tert-butyl-4-ethylphenol) | 0.70 g |

Each of the photosensitive materials thus obtained which were non-photosensitive under normal light conditions was preliminarily heated at 100° C. for 5 seconds in a dark room, and then exposed to light from a 500 watt xenon lamp for one eighth of second through a mask film and subsequently heated at 130° C. for 1 second to develop a negative image.

The maximum optical densities and the minimum optical densities of the images thus obtained are shown in Table 1.

Further, each of the photosensitive materials was kept at 50° C. at a relative humidity of 90% for 24 hours in a dark room prior to the preliminary heating in order to test its storage stability, and subsequently an image was formed thereon in the same manner as described above.

The maximum optical densities and the minimum optical densities of the images thus obtained are also shown in Table 1.

Table 1

| Run No. | Nitrogen-containing Organic Base | (g) | pKa of Conjugate Acid | Optical Density of Image Maximum | Minimum | Maximum* | Minimum* |
|---|---|---|---|---|---|---|---|
| 1 | Pyridine | 0.30 | 5.2 | 1.88 | 0.06 | 1.83 | 0.07 |
| 2 | Quinoline | 0.30 | 4.9 | 2.55 | 0.06 | 2.50 | 0.06 |
| 3 | Isoquinoline | 0.30 | 5.4 | 2.63 | 0.07 | 2.54 | 0.07 |
| 4 | Phthalazine | 0.05 | 3.5 | 2.23 | 0.06 | 2.30 | 0.06 |
| 5 | Quinazoline | 0.60 | 3.5 | 2.41 | 0.06 | 2.13 | 0.07 |
| 6 | Pyrazine | 0.03 | 6.0 | 1.96 | 0.07 | 1.90 | 0.08 |
| 7 | Pyridazine | 0.30 | 2.3 | 1.55 | 0.06 | 1.48 | 0.08 |
| 8 | Pyrimidine | 0.30 | 1.3 | 2.20 | 0.08 | 1.21 | 0.09 |
| 9 | Quinoxaline | 0.60 | 0.7 | 1.90 | 0.06 | 1.90 | 0.06 |
| 10 | Cinnoline | 0.30 | 2.3 | 1.92 | 0.06 | 1.89 | 0.07 |
| 11 | Pyrazole | 0.05 | 2.5 | 2.38 | 0.07 | 2.44 | 0.09 |
| 12 | N-Ethyl-morpholine | 0.10 | 7.6 | 1.89 | 0.08 | 1.85 | 0.09 |
| 13 | Piperazine | 0.10 | 9.8 | 1.78 | 0.09 | 1.76 | 0.10 |

Table 1-continued

| Run No. | Nitrogen-containing Organic Base | (g) | pKa of Conjugate Acid | Optical Density of Image Maximum | Minimum | Maximum* | Minimum* |
|---|---|---|---|---|---|---|---|
| Comparative Run No. | | | | | | | |
| 1 | None | — | — | 0.34 | 0.06 | 0.17 | 0.07 |
| 2 | N-Methyl-piperidine | 0.10 | 10.1 | 1.88 | 0.10 | 1.79 | 0.34 |
| 3 | N-Methyl-pyrrolidine | 0.10 | 10.4 | 1.75 | 0.11 | 1.70 | 0.33 |
| 4 | Pyrrolidine | 0.05 | 11.3 | 1.83 | 0.10 | 1.66 | 0.30 |
| 5 | Azetidine | 0.10 | 11.3 | 1.83 | 0.10 | 1.83 | 0.29 |

*The image was formed on the photosensitive material after the storage stability test.

EXAMPLE 2

The same procedures as described in Run Nos. 1 to 5 and Comparative Run No. 1 of Example 1 were repeated except that 0.28 g of phthalimide was used instead of the phthalazinone and that 0.70 g of 2,6-bis(2'-hydroxy-3'-tert-butyl-5'-methylbenzyl)-4-methylphenol was used instead of the 2,2'-methylenebis(6-tert-butyl-4-ethylphenol).

The maximum optical densities and the minimum optical densities of the images thus formed and those of the images formed after the same storage stability test as in Example 1 are shown in Table 2 below.

Table 2

| Run No. | Nitrogen-containing Organic Base | (g) | Optical Density of Image Maximum | Minimum | Maximum* | Minimum* |
|---|---|---|---|---|---|---|
| 1 | Pyridine | 0.30 | 1.77 | 0.06 | 1.76 | 0.07 |
| 2 | Quinoline | 0.30 | 1.86 | 0.06 | 1.79 | 0.07 |
| 3 | Isoquinoline | 0.30 | 1.63 | 0.07 | 1.58 | 0.07 |
| 4 | Phthalazine | 0.10 | 1.80 | 0.06 | 1.75 | 0.07 |
| 5 | Quinazoline | 0.20 | 1.71 | 0.06 | 1.80 | 0.08 |
| Comparative Run No. | | | | | | |
| 1 | None | — | 0.22 | 0.06 | 0.20 | 0.07 |

*The image was formed on the photosensitive material after the same storage stability test as in Example 1.

EXAMPLE 3

The same procedure as described in Run Nos. 1 to 5 and Comparative Run No. 1 of Example 1 were repeated except that 0.28 g of maleic hydrazide was used instead of the phthalazinone.

The maximum optical densities and the minimum optical densities of the image thus formed and those of the images formed after the same storage stability test as in Example 1 are shown in Table 3 below.

Table 3

| Run No. | Nitrogen-containing Organic Base | (g) | Optical Density of Image Maximum | Minimum | Maximum* | Minimum* |
|---|---|---|---|---|---|---|
| 1 | Pyridine | 0.30 | 1.38 | 0.06 | 1.21 | 0.07 |
| 2 | Quinoline | 0.30 | 1.29 | 0.06 | 1.30 | 0.07 |
| 3 | Isoquinoline | 0.30 | 1.41 | 0.06 | 1.38 | 0.07 |
| 4 | Phthalazine | 0.30 | 1.63 | 0.07 | 1.64 | 0.07 |
| 5 | Quinazoline | 0.30 | 1.32 | 0.06 | 1.33 | 0.07 |
| Comparative Run No. | | | | | | |
| 1 | None | — | 0.23 | 0.06 | 0.21 | 0.07 |

*The image was formed on the photosensitive material after the same storage stability test as in Example 1.

EXAMPLE 4

The same procedures of producing photosensitive materials as described in Run Nos. 1 to 3 and Comparative Run No. 1 of Example 1 were repeated except that 0.12 g of the complex of bromine with p-dioxane was used instead of the iodine molecule.

Each of the photosensitive materials thus obtained was preliminarily heated at 110° C. for 3 seconds in a dark room, and then exposed to light from a 300 watt tungsten lamp for one eighth of second through a mask film and subsequently heated at 130° C. for 3 seconds to develop a negative image.

The maximum optical densities and the minimum optical densities of the image thus formed and those of the images formed after the same storage stability test as in Example 1 are shown in Table 4 below.

Table 4

| Run No. | Nitrogen-containing Organic Base (g) | | Optical Density of Image Maximum | Minimum | Maximum* | Minimum* |
|---|---|---|---|---|---|---|
| 1 | Pyridine | 0.30 | 1.11 | 0.06 | 1.03 | 0.07 |
| 2 | Quinoline | 0.30 | 1.09 | 0.06 | 1.04 | 0.07 |
| 3 | Isoquinoline | 0.30 | 0.99 | 0.07 | 1.00 | 0.07 |
| Comparative Run No. 1 | None | — | 0.22 | 0.05 | 0.18 | 0.07 |

*The image was formed on the photosensitive material after the same storage stability test as in Example 1.

COMPARATIVE EXAMPLE 1

The same procedures as described in Run Nos. 1 to 3 and Comparative Run No. 1 of Example 1 were repeated except that 0.10 g of ammonium bromide was used instead of the iodine molecule and that the preparation of the heat developable photosensitive materials was conducted in a dark room.

The maximum optical densities and the minimum optical densities of the images thus formed and those of the images formed after the same storage stability test as in Example 1 are shown in Table 5 below.

Table 5

| Run No. | Nitrogen-containing Organic Base (g) | | Optical Density of Image Maximum | Minimum | Maximum* | Minimum* |
|---|---|---|---|---|---|---|
| 1 | Pyridine | 0.30 | 2.30 | 0.07 | 2.21 | 2.21 |
| 2 | Quinoline | 0.30 | 2.06 | 0.06 | 2.06 | 2.00 |
| 3 | Isoquinoline | 0.30 | 2.11 | 0.06 | 2.06 | 2.01 |
| Comparative Run No. 1 | None | — | 0.11 | 0.06 | 0.12 | 0.06 |

*The image was formed on the photosensitive material after the same storage stability test as in Example 1.

EXAMPLE 5

An emulsion having the composition as set forth below was prepared by mixing each of its ingredients in the order described therein with stirring and coated on a sheet of art paper, and then dried in air.

| Composition | |
|---|---|
| The same silver behenate suspension as in Example 1 | 1.5 g |
| Methyl ethyl ketone solution containing 14 percent by weight of polyvinyl butyral | 1.2 g |
| Mercuric acetate | 1 mg |
| Iodine bromide | 14 mg |
| Nitrogen-containing organic base as shown below* | 30 mg |
| Phthalazinone | 30 mg |
| 2,2'-Methylenebis(6-tert-butyl-4-ethylphenol) | 70 mg |

*(1) Quinoline
(2) Isoquinoline
(3) 1-Methylpyrrolidinone
(4) 1-Methylpyridone
(5) None Each of the photosensitive materials thus obtained was preliminarily heated at 100° C. for 4 seconds in a dark room and then exposed to light from a 150 watt xenon lamp for one fifth of second through a mask film, and subsequently heated at 120° C. for 6 seconds to develop a negative image.

The photosensitive material containing the quinoline or the isoquinoline as a nitrogen-containing organic base gave a very clear dark image with high contrast. On the other hand, the photosensitive material without the nitrogen-containing organic base or containing the 1-methylpyrrolidinone or the 1-methylpyridone gave a light brown with very low contrast.

EXAMPLE 6

A benztriazole silver suspension was prepared in the same manner as described in Example 1 except that the same amount of benztriazole silver salt as the silver behenate was used instead of the silver behenate.

An emulsion having the composition as set forth below was prepared by mixing each of its ingredients in the order described therein with stirring and coated on a sheet of paper, and then dried.

| Composition | |
|---|---|
| Benztriazole silver suspension | 12.0 g |
| Polyvinyl butyral | 2.5 g |
| Methyl ethyl ketone | 12.0 g |
| Mercuric acetate | 0.025 g |
| Iodine molecule | 0.12 g |
| Phthalazinone | 0.25 g |
| Tert-butylhydroquinone | 0.40 g |
| Quinoline | 0.40 g |

The photosensitive material thus obtained was preliminarily heated at 100° C. for 5 seconds with a hot roll in a dark room and then exposed to light from a 1 KW photograph lamp for one thirtieth of second through a mask film, followed by heat development at 130° C. for 2 minutes. The image thus obtained was very dark and clear. On the other hand, the image formed on the photosensitive material containing no quinoline was barely observed in light brown color.

EXAMPLE 7

An emulsion having the first layer composition as set forth below was prepared by mixing each of its ingredients in the order described therein with stirring and coated on a polyester film and then dried.

| First Layer Composition | |
|---|---|
| The same silver behenate suspension as in Example 1 | 12.0 g |
| Polyvinyl butyral | 3.0 g |

-continued

| First Layer Composition | |
|---|---|
| Methyl ethyl ketone | 12.0 g |
| Mercuric acetate | 0.05 g |
| Diphenyltellurium dibromide | 0.05 g |
| Iodine molecule | 0.10 g |
| Nitrogen-containing organic base in an amount as shown in Table 6. | |

Then, another solution having the second layer composition as set forth below was prepared and coated on the first layer as the second layer, and then dried.

| Second Layer Composition | |
|---|---|
| Polymethyl methacrylate | 1.2 g |
| Methyl ethyl ketone | 16.3 g |
| Phthalazinone | 0.28 g |
| 2,2'-Methylenebis(6-tert-butyl-4-methylphenol) | 0.70 g |

Each of the photosensitive materials thus obtained which were non-photosensitive under normal light conditions was preliminarily heated at 110° C. for 1 second in a dark room, and then exposed to light from a 300 watt tungsten lamp for one sixtieth of second through a mask film and subsequently heated at 120° C. for 3 seconds to develop a negative image.

The maximum optical densities and the minimum optical densities of the images thus obtained are shown in Table 6.

Further, each of the photosensitive materials was kept at 60° C. at a relative humidity of 90% for one hour in a dark room prior to the preliminary heating in order to test its storage stability, and subsequently an image was formed thereon in the same manner as described above.

The maximum optical densities and the minimum optical densities of the images thus obtained are also shown in Table 6.

Table 6

| Run No. | Nitrogen-containing Organic Base (g) | | pKa of Conugate Acid | Optical Density of Image Maximum | Minimum | Maximum* | Minimum* |
|---|---|---|---|---|---|---|---|
| 1 | Quinoline | 0.30 | 4.9 | 1.99 | 0.07 | 1.81 | 0.07 |
| 2 | 2-Methyl-quinoline | 0.30 | 5.4 | 1.86 | 0.06 | 1.85 | 0.06 |
| 3 | 5-Methyl-quinoline | 0.30 | 4.6 | 1.90 | 0.06 | 1.91 | 0.06 |
| 4 | 3-Chloro-quinoline | 0.30 | 2.4 | 1.60 | 0.06 | 1.43 | 0.06 |
| 5 | Pyridine | 0.30 | 5.2 | 1.47 | 0.07 | 1.30 | 0.07 |
| 6 | α,α'-Dipyridyl | 0.15 | 4.4 | 1.88 | 0.06 | 1.87 | 0.06 |
| 7 | α,α'-Nitro-1,10-phenanthroline | 0.30 | 3.75 | 1.55 | 0.08 | 1.51 | 0.09 |
| 8 | 2-Tert-butyl-pyridine | 0.30 | 5.8 | 2.01 | 0.07 | 2.10 | 0.08 |
| 9 | 2,6-Diisopropyl-pyridine | 0.30 | 5.3 | 1.97 | 0.06 | 2.10 | 0.09 |
| 10 | 3-Acetylpyridine | 0.30 | 3.2 | 1.68 | 0.07 | 1.56 | 0.07 |
| 11 | Pyrimidine | 0.30 | 1.3 | 1.54 | 0.08 | 1.44 | 0.08 |
| 12 | 4-Methyl-pyrimidine | 0.20 | 2.0 | 1.73 | 0.08 | 1.74 | 0.08 |
| 13 | Phthalazine | 0.10 | 3.5 | 2.25 | 0.06 | 2.20 | 0.06 |
| 14 | Pyrazole | 0.10 | 2.5 | 1.58 | 0.07 | 1.50 | 0.09 |
| 15 | 3-Methyl-pyrazole | 0.10 | 3.6 | 1.90 | 0.06 | 2.00 | 0.09 |
| Comparative Run No. | | | | | | | |
| 1 | None | — | — | 0.20 | 0.06 | 0.18 | 0.08 |
| 2 | Benztriazole** | 0.30 | 1.6 | 0.53 | 0.06 | 0.48 | 0.06 |
| 3 | Tetrazole*** | 0.30 | — | 0.42 | 0.05 | 0.36 | 0.06 |
| 4 | 1-Methyl-pyrrolidinone | 0.30 | <<1 (<0.5) | 0.22 | 0.06 | 0.20 | 0.07 |

*The image was formed on the photosensitive material after the storage stability test.
**The pKa of the acidic proton of the benzotriazole was 8.57.
***The pKa of the acidic proton of the tetrazole was 4.9.

EXAMPLE 8

The same procedures as described in Example 7 were repeated except that 0.10 g of N-iodophthalimide was used instead of the iodine molecule.

The maximum optical densities and the minimum optical densities of the images thus formed and those of the images formed after the same storage stability test as in Example 7 are shown in Table 7 below.

Table 7

| Run No. | Nitrogen-containing Organic Base (g) | | Optical Density of Image Maximum | Minimum | Maximum* | Minimum* |
|---|---|---|---|---|---|---|
| 1 | Quinoline | 0.30 | 1.32 | 0.06 | 1.27 | 0.07 |
| 2 | 2-Methylquinoline | 0.30 | 1.16 | 0.07 | 1.09 | 0.07 |
| 3 | 5-Methylquinoline | 0.30 | 1.30 | 0.06 | 1.29 | 0.07 |
| 4 | 3-Chloroquinoline | 0.30 | 1.09 | 0.06 | 1.09 | 0.07 |
| 5 | Pyridine | 0.30 | 1.24 | 0.06 | 1.22 | 0.08 |
| 6 | α,α'-Dipyridyl | 0.30 | 1.00 | 0.06 | 1.01 | 0.07 |

Table 7-continued

| Run No. | Nitrogen-containing Organic Base (g) | | Optical Density of Image Maximum | Minimum | Maximum* | Minimum* |
|---|---|---|---|---|---|---|
| 7 | 2-Tert-butyl pyridine | 0.30 | 1.35 | 0.07 | 1.33 | 0.07 |
| 8 | 2,2-Diisopropyl-pyridine | 0.30 | 1.08 | 0.06 | 1.01 | 0.07 |
| 9 | 3-Acetylpyridine | 0.30 | 1.41 | 0.06 | 1.35 | 0.07 |
| 10 | Pyrimidine | 0.30 | 1.27 | 0.06 | 1.29 | 0.07 |
| 11 | 4-Methylpyrimidine | 0.20 | 1.11 | 0.06 | 1.10 | 0.08 |
| 12 | Phthalazine | 0.10 | 1.52 | 0.07 | 1.51 | 0.07 |
| 13 | Pyrazole** | 0.10 | 1.33 | 0.05 | 1.33 | 0.06 |
| 14 | 3-Methylpyrazole | 0.10 | 1.34 | 0.06 | 1.35 | 0.07 |
| 15 | Benzimidazole*** | 0.30 | 1.38 | 0.06 | 1.41 | 0.07 |
| Comparative Run No. | | | | | | |
| 1 | None | — | 0.10 | 0.06 | 0.10 | 0.08 |
| 2 | Benztriazole | 0.30 | 0.27 | 0.06 | 0.20 | 0.07 |
| 3 | Tetrazole | 0.30 | 0.29 | 0.06 | 0.20 | 0.07 |
| 4 | 3,6-Diazaindole**** | 0.30 | 0.41 | 0.06 | 0.38 | 0.06 |

*The image was formed on the photosensitive material after the same storage stability test as in Example 7.
**The pKa of the acidic proton of the pyrazole was 14.0.
***The pKa of the acidic proton of the benzimidazole was 12.3 and the pKa of the conjugate acid was 5.53.
****The pKa of the acidic proton of the 3,6-diazaindole was 10.88 and the pKa of the conjugate acid was 6.1.

EXAMPLE 9

The same procedures as described in Run Nos. 1 to 5, 7 to 9 and 11 and Comparative Run Nos. 1 and 4 in Example 1 was repeated except that 0.12 g of N-iodosuccinimide was used instead of the iodine molecule and that the thickness of the first layer was 3$\mu$ instead of 4$\mu$ and the total thickness of the first and the second layers was 6$\mu$ instead of 7$\mu$.

The maximum optical densities and the minimum optical densities of the images thus formed and those of the images after the same storage stability test as in Example 1 are shown in Table 8 below.

Table 8

| Run No. | Nitrogen-containing Organic Base (g) | | Optical Density of Image Maximum | Minimum | Maximum* | Minimum* |
|---|---|---|---|---|---|---|
| 1 | Pyridine | 0.30 | 1.32 | 0.08 | 1.27 | 0.09 |
| 2 | Quinoline | 0.30 | 1.29 | 0.08 | 1.28 | 0.09 |
| 3 | Isoquinoline | 0.30 | 1.33 | 0.08 | 1.29 | 0.08 |
| 4 | Phthalazine | 0.05 | 1.51 | 0.08 | 1.50 | 0.08 |
| 5 | Quinazoline | 0.60 | 1.40 | 0.08 | 1.38 | 0.08 |
| 6 | Pyridazine | 0.30 | 1.41 | 0.07 | 1.42 | 0.09 |
| 7 | Pyrimidine | 0.30 | 1.33 | 0.08 | 1.31 | 0.09 |
| 8 | Quinoxaline | 0.60 | 1.37 | 0.08 | 1.33 | 0.08 |
| 9 | Pyrazole | 0.05 | 1.34 | 0.08 | 1.30 | 0.08 |
| Comparative Run No. | | | | | | |
| 1 | None | — | 0.16 | 0.07 | 0.13 | 0.09 |
| 2 | Pyrrolidine | 0.05 | 1.39 | 0.08 | 1.36 | 0.17 |

*The image was formed on the photosensitive material after the same stability test as in Example 1.

EXAMPLE 10

The same procedures as described in Run Nos. 1 to 5 and Comparative Run No. 1 in Example 1 were repeated except that 0.12 g of N-bromophthalazinone was used instead of the iodine molecule and that 0.28 g of phthalimide was used instead of the phthalazinone and the the heat-development was carried out at 120° C. for 10 seconds.

The maximum optical densities and the minimum optical densities of the images thus formed and those of the images after the same stability test as in Example 1 are shown in Table 9 below.

Table 9

| Run No. | Nitrogen-containing Organic Base (g) | | Optical Density of Image Maximum | Minimum | Maximum* | Minimum* |
|---|---|---|---|---|---|---|
| 1 | Pyridine | 0.20 | 1.12 | 0.07 | 1.10 | 0.08 |
| 2 | Quinoline | 0.20 | 1.23 | 0.07 | 1.17 | 0.07 |
| 3 | Isoquinoline | 0.20 | 1.21 | 0.06 | 1.22 | 0.06 |
| 4 | Phthalazine | 0.20 | 1.08 | 0.06 | 1.09 | 0.06 |
| 5 | Quinozaline | 0.20 | 1.19 | 0.06 | 1.18 | 0.07 |
| Comparative Run No. | | | | | | |
| 1 | None | — | 0.11 | 0.06 | 0.11 | 0.06 |

*The image was formed on the photosensitive material after the storage stability test as in Example 1.

EXAMPLE 11

A silver stearate suspension was prepared in the same manner as in Example 1 except that the same amount of silver stearate as the silver behenate was used instead of the silver behenate.

An emulsion having the composition as set forth below was prepared by mixing each of its ingredients in the order described therein with stirring and coated on a sheet of art paper, and then dried.

| Composition | |
|---|---|
| Silver stearate suspension | 12.0 g |
| Polyvinyl butyral | 3.0 g |
| Methyl ethyl ketone | 12.0 g |
| N-Bromosuccinimide | 0.05 g |
| Mercuric acetate | 0.01 g |
| Maleinimide | 0.5 g |
| Nitrogen-containing organic base as shown below* | 0.1 g |
| 2,6-Bis(2'-hydroxy-3'-tert-butyl-5'-methylbenzyl)-4-methylphenol | 1.5 g |

*(1) Phthalazine
(2) Pyridine
(3) Quinoline
(4) Isoquinoline
(5) Quinazoline
(6) Cinnoline
(7) None Each of the photosensitive materials thus obtained was preliminarily heated at 100° C. for 5 seconds with a hot roll, and then exposed to light from a 500 watt tungsten lamp for one eighth of second through a mask film, and subsequently heated at 130° C. for 2 seconds with a hot roll to develop a negative image.

The image formed on the photosensitive material not containing the nitrogen-containing organic base was barely observed in yellow color.

On the other hand, the image formed on the photosensitive material containing the phthalazine, pyridine, quinoline, isoquinoline, quinazoline or cinnoline was dark and clear, and the storage stability of the photosensitive was excellent.

While the invention has been described in detail and with reference to specific embodiments thereof, it will be apparent to one skilled in the art that various changes and modifications can be made therein without departing from the spirit and scope thereof.

What is claimed is:

1. In a heat developable photosensitive material comprising:

(a) an organic silver salt oxidizing agent;

(b) a halogen molecule or an organic haloamide compound; and (c) a reducing agent for silver ion; the improvement which comprises incorporating therein (d) at least one nitrogen-containing organic base selected from the group consisting of pyridine, quinoline, isoquinoline, acridine, phenanthridine, pyridazine, pyrimidine, pyrazine, cinnoline, phthalazine, quinazoline, quinoxaline, phenazine, m-, o-, p-phenanthroline, pteridine, pyrazole, imidazole, benzimidazole, 2-chloropyridine, 3-chloropyridine, 2-bromopyridine, 3-bromopyridine, 2-methylpyridine, 3-methylpyridine, 4-methylpyridine, 2,6-diisopropylpyridine, 2-isopropylpyridine, 2-tert-butylpyridine, 3-phenylpyridine, 2,6-di-tert-butylpyridine, 3-acetylpyridine, $\alpha\alpha'$-dipyridyl, $\beta,\beta'$-dipyridyl, $\gamma,\gamma'$-dipyridyl, 5-nitro-1,10-phenanthroline, 2-methylquinoline, 3-methylquinoline, 4-methylquinoline, 2-chloroquinoline, 4-chloroquinoline, 2-methoxyisoquinoline, 4-methylpyrimidine, 2-dimethylaminopyrimidine, 2-methoxyquinazoline, 2-methylquinoxaline, 1-methylpyrazole and 2-methylpyrazole, in an amount of about 0.001 mole to about 1 mole per mole of the organic silver salt oxidizing agent (a).

2. The heat developable photosensitive material of claim 1, wherein the halogen molecule is at least one compound sleected from the group consisting of molecular iodine, molecular bromine, iodine monochloride, iodine trichloride, iodine bromide and bromine chloride.

3. The heat developable photosensitive material of claim 1, wherein the halogen molecule is molecular iodine.

4. The heat developable photosensitive material of claim 1, wherein the organic haloamide compound is at least one compound selected from the group consisting of N-chlorosuccinimide, N-bromosuccinimide, N-iodosuccinimide, N-chlorophthalimide, N-bromophthalimide, N-iodophthalimide, N-chlorophthalazinone, N-bromophthalazinone, N-iodophthalazinone, N-chloroacetamide, N-bromoacetamide, N-iodoacetamide, N-chloroacetanilide, N-bromoacetanilide, N-iodoacetanilide, 1-chloro-3,5,5-trimethyl-2,4-imidazolidinedione, 1-bromo-3,5,5-trimethyl-2,4-imidazolidinedione, 1-iodo-3,5,5-trimethyl-2,4-imidazolidinedione, 1,3-di-chloro-5,5-dimethyl-2,4-imidazolidinedione, 1,3-dibromo-5,5-dimethyl-2,4-imidazolidinedione, 1,3-diiodo-5,5-dimethylimidazolidinedione, N,N-dichlorobenzenesulfonamide, N,N-dibromobenzenesulfonamide, N-bromo-N-methylbenzenesulfonamide, N-chloro-N-methylbenzenesulfonamide, N,N-diiodobenzenesulfonamide, N-iodo-N-methylbenzenesulfonamide, 1,3-dichloro-4,4-dimethylhydantoin, 1,3-dibromo-4,4-dimethylhydantoin and 1,3-diiodo-4,4-dimethylhydantoin.

5. The heat developable photosensitive material of claim 1, wherein the amount of the halogen molecule or the organic halomide compound (b) ranges from about 0.001 mole to about 0.5 mole per mole of the organic silver salt oxidizing agent (a).

6. The heat developable photosensitive material of claim 1, wherein the organic silver salt oxidizing agent (a) is a silver salt of a long chain aliphatic carboxylic acid having 12 to 24 carbon atoms.

7. The heat developable photosensitive material of claim 6, wherein the organic silver salt oxidizing agent (a) is silver behenate.

8. The heat developable photosensitive material of claim 1, wherein the amount of the organic silver salt oxidizing agent (a) ranges from about 0.1 $g/m^2$ to about 50 $g/m^2$ of the support area of the heat developable photosensitive material.

9. The heat developable photosensitive material of claim 1, wherein the amount of the reducing agent for silver ion (c) ranges from about 0.1 percent by weight to about 200 percent by weight based on the weight of the organic silver salt oxidizing agent (a).

10. The heat developable photosensitive material of claim 1, wherein the reducing agent for silver ion (c) is 2,2-methylenebis (4-ethyl-6-tert-butylphenol).

11. The heat developable photosensitive material of claim 1, wherein (b) is an organic iodoamide.

* * * * *